US005967393A

United States Patent [19]

Clarke, III

[11] Patent Number: 5,967,393

[45] Date of Patent: Oct. 19, 1999

[54] SUBTERFUGE HOLSTER

[76] Inventor: Stuart J. Clarke, III, 1146 Greenstone Blvd. #206, Heathrow, Fla. 32746

[21] Appl. No.: 08/932,563

[22] Filed: Sep. 19, 1997

[51] Int. Cl.[6] ..... F41C 33/02; A45F 5/00

[52] U.S. Cl. ..... 224/587; 224/666; 224/677; 224/236; 224/238; 224/240; 224/911; 224/901.6; 206/317; 206/457

[58] Field of Search ..... 224/587, 666, 224/677, 911, 240, 236, 237, 238, 235, 901.6; 206/457, 317; 446/26, 28; 362/154, 155, 156; D3/222, 223, 218, 230

[56] References Cited

U.S. PATENT DOCUMENTS

| | | | |
|---|---|---|---|
| D. 218,005 | 7/1970 | Woolfolk | D3/222 |
| 5,001,462 | 3/1991 | Seemann et al. | 362/156 |
| 5,584,424 | 12/1996 | Stava | 224/240 |

*Primary Examiner*—Linda J. Sholl
*Attorney, Agent, or Firm*—Brian S. Steinberger; Law Offices of Brian S. Steinberger

[57] ABSTRACT

A concealed weapon holster having an exterior facade that looks like a carrying case or has the appearance of a beeper/pager/battery pack and a portable phone/radio. A clip having a fixed through-hole on the back of the case allows a belt to be inserted therein. The case has an upside down L-shape with a rigid antenna connected to an upwardly raised from the case. The wearer pushes the antenna away from their body causing the case to open a front portion allowing a weapon to be rapidly withdrawn. Sides of the case can be attached together by Velcro® type fasteners, zippers, snaps and the like. A bottom portion of the vertical section of the case can remain fixably together and can hold the muzzle of a firearm pistol. An optional foam insert can be used inside the case to hold the weapon in place. The case can include flashing light(s) and beep/ring sound producing to further enhance the realism of the case. A safety switch on the case can prevent accidental release of the weapon. The case can house a variety of weapons such as firearm pistols, electronic discharge weapons, aerosol spray weapons, knifes and the like.

17 Claims, 6 Drawing Sheets

Fig. 6
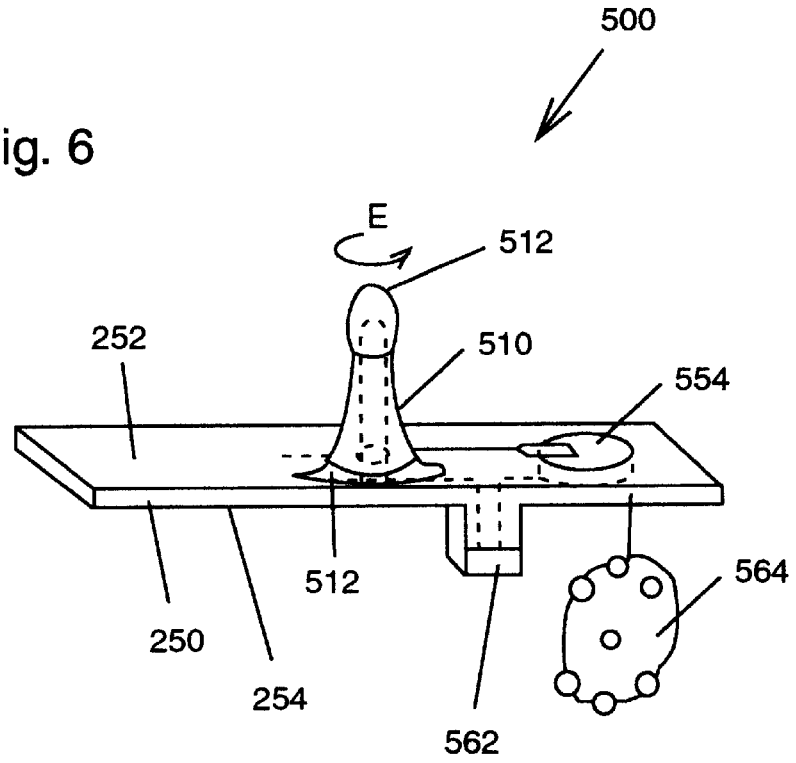
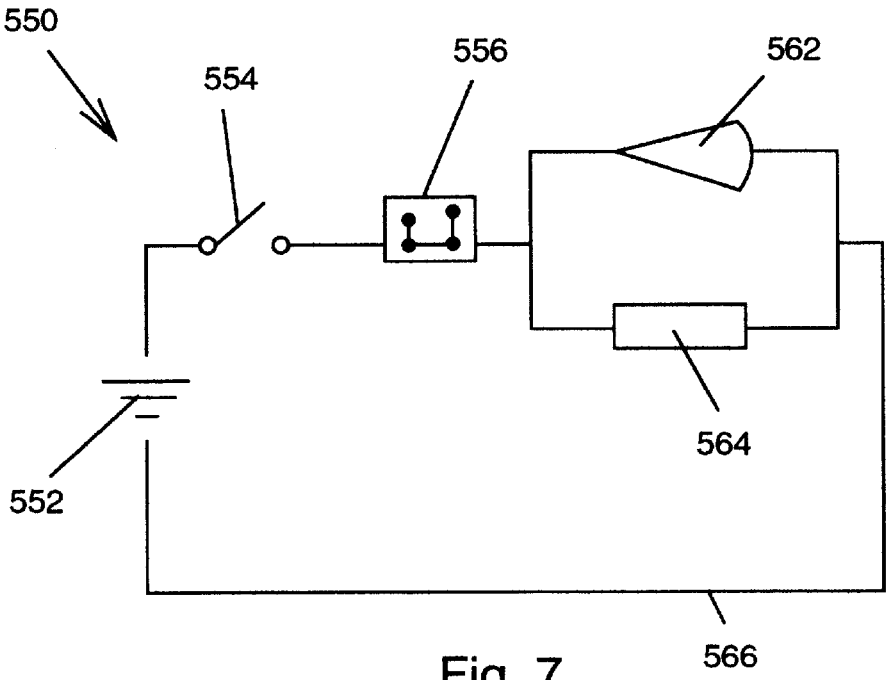
Fig. 7

SUBTERFUGE HOLSTER

This invention relates to holsters for weapons, and in particular to a weapon holster disguised to resemble a carrying case for a pager/beeper and portable phone/radio.

BACKGROUND AND PRIOR ART

Weapon holsters have been used throughout history for supporting swords in mideviel times to the 19th century western holsters for firearms. Typical weapon holsters are in plain view to appear as weapon holsters when seen by others. The U.S. through the second amendment to the Constitution referred to as the "right to bear arms" has allowed individual states to enact laws allowing citizens the right to own and carry firearms. Many states such as Florida have allowed for concealed weapons permits, where a user for a permit fee and from taking a state approved course can carry their firearm weapon in a concealed fashion on their person.

However, the concealed weapon permits have been problematic in implementation. The majority of current concealed weapon type holsters must be deeply hidden beneath layers of clothing and are thus not immediately accessible during an emergency. For example, a popular shoulder type holster has the firearm supported under a user's armpit area usually beneath an outer piece of clothing such as a jacket. Another popular type of concealed weapon's holster must be worn on the lower part of the leg, which can be a distant reach for use in an emergency. The common citizen in an emergency would have a split second to fumble through opening their jacket or lift up a pants leg in order to raise and draw the weapon during an emergency. This lengthy delay helps the aggressor realize the victim is trying to defend themselves, and in essence gives the aggressor time to prepare, react and ruin any element of surprise by the victim. The hand maneuvering necessary to reach their concealed weapon also puts the victim in a more defenseless position by restricting at least one of their hands to be used to defend against the aggressor. Using these holsters has further difficulties if the aggressor is fleeing on foot and the victim has to give chase, and must then grope through their clothing to retrieve their weapon while running.

Attempts have been made to carry a concealed weapon but have failed to overcome the problems addressed above. Many women have used their purses to conceal their firearms. However, the purse holders require using at least one of their hands or a shoulder to support the purse at all times. Unzipping a purse with the other hand puts both hands temporarily out-of-commission until the weapon is drawn.

Still furthermore, "fanny packs" have been used where hook and loop fasteners such as Velcro® fasten about a user's belt. However, these hook and loop fasteners can allow the gun to be stolen by being pulled off the wearer. Additionally these types of fasteners can be disengaged causing the holster to drop during quick jerking motions. The resultant loss of the weapon could cost the life of the user or other innocent persons. Additionally, "fanny packs" do not go with and would look out-of-place with formal work clothing such as dress shirts and ties.

U.S. Pat. No. 5,584,424 to Stava, describes a "weapon pouch and disguise." The Stava patent describes a large obtrusive rectangular type pouch with zipable panels. The large rectangular pouch is labelled "POLICE" and is described primarily for use by law enforcement persons. Regular citizens would not wish to nor under the law be able to identify themselves as law enforcement persons, and thus would have difficulty using this device. Furthermore, the large bulky nature of this pouch must be oversized to complete encompass a firearm and would be too bulky for many persons such as women to use. Still furthermore, the '424 patent requires hook straps 31, 32 FIG. 3 to support the firearm separately against the back wall inside the rectangular pouch. During an emergency these straps could inhibit immediate withdrawal of the firearm. Still furthermore, the Stava '424 patent requires the wearer to "firmly" pull down on a lanyard type hanging cord labelled a thong 25 FIG. 1. Grabbing this loose hanging cord could be difficult in an emergency when the user may have to take their eyes off the aggressor to locate the flimsy hanging lanyard type cord. Using this pull cord is even more difficult if the wearer is walking and running which would cause the lanyard type cord to be moving and swinging about. The user would have more difficulty locating and grabbing about the hanging cord.

Thus, the need exists for a practical solution to the above problems with the prior art.

SUMMARY OF THE INVENTION

The first objective of the present invention is to provide a holster for carrying a concealed weapon having an exterior appearance for housing an electronic phone/radio and beeper/pager.

The second object of this invention is to provide a holster for carrying a concealed weapon that can be worn with both formal work clothes and casual clothes without appearing out-of-place.

The third object of this invention is to provide a holster for a concealed weapon that allows a wearer to quickly open the holster by pushing an upwardly extending realistic antenna.

The fourth object of this invention is to provide a holster for housing concealed wherein the holster cannot be pulled off the belt of a wearer.

A preferred embodiment of the concealed holster for a weapon includes an upside down L-shaped holster having a horizontal housing portion, a vertical housing portion, a front face and a rear face, the front face disguising the holster to be housing equipment other than a weapon, and a clip for allowing a belt to be worn by a user to support the holster, wherein the holster supports and substantially conceals a weapon inside. The holster includes an exterior face that represents that both a pager/beeper/battery pack, and a portable phone/radio transmitter-receiver are inside the holster. Realistic blinking lights and beeper/ringing sounds can be produced by circuitry inside the holster. The lower section of the vertical rectangular section stays closed for allowing the muzzle of a firearm to be held therein. In operation, a rigid antenna connected to and upwardly extending from the holster is used by a hand of the user to quickly open the holster and allow the weapon to be retrieved. Optionally, the antenna can be part of an actual portable phone and a radio transmitter-receiver, that is housed in a front pocket of the holster in front of the weapon. Upper portions of the front face and the rear face can be fastened together with zippers, hook and loop fasteners, snaps, and the like. A foam insert can be attached into the holster to further hold the weapon in place. The holster can house weapons such as a firearm, a spray dispenser, a knife, and an electrical discharge weapon. A safety switch can also be used on the holster for preventing accidental release of the weapon.

Further objects and advantages of this invention will be apparent from the following detailed description of a presently preferred embodiment which is illustrated schematically in the accompanying drawings.

BRIEF DESCRIPTION OF THE FIGURES

FIG. 6 is an enlarged view of an optional light that can be used with the antenna of FIGS. 1–3.

FIG. 7 is a schematic circuit that can be used with the light of FIG. 6.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
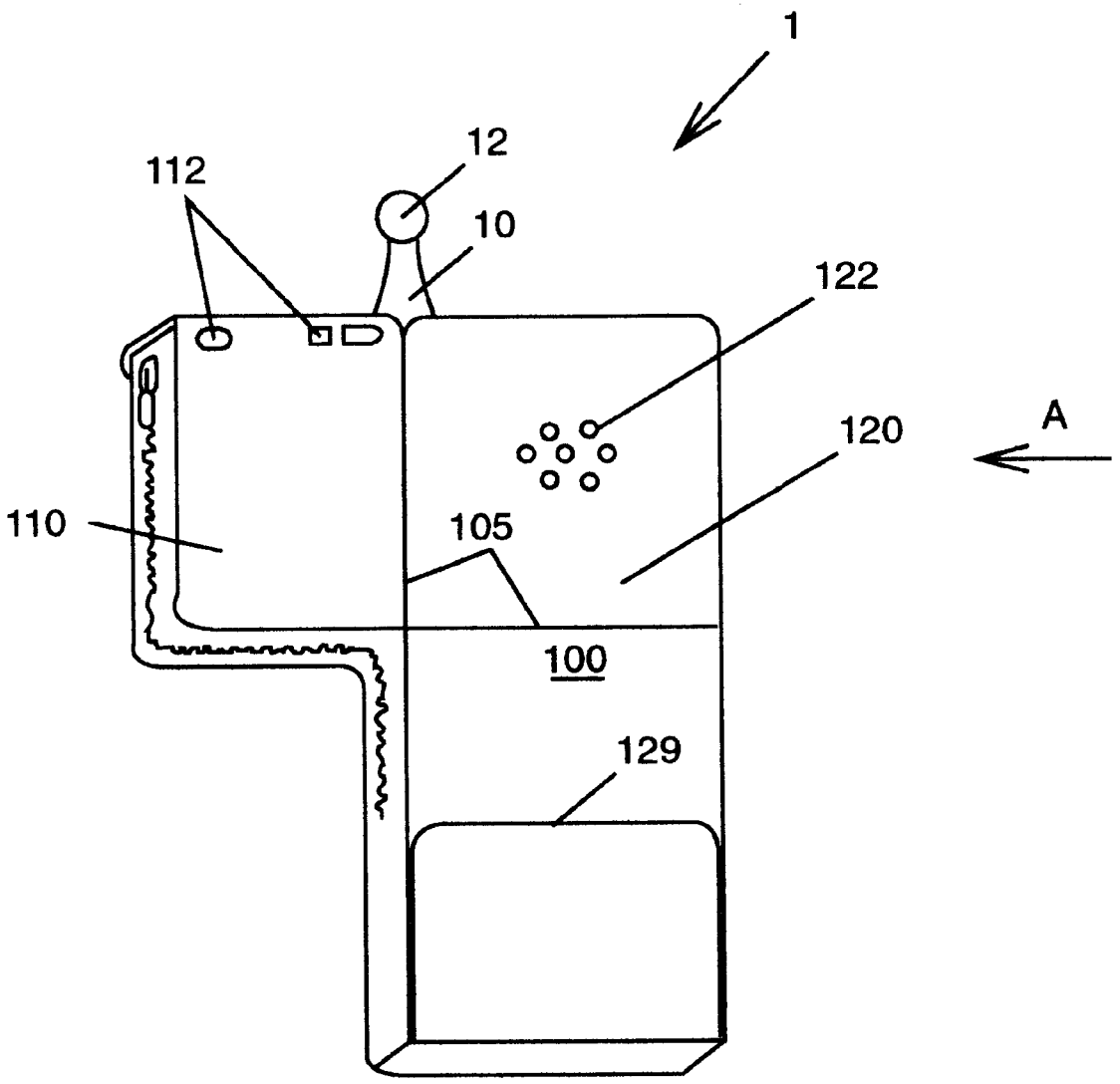
FIG. 1 is a perspective view of a preferred embodiment of the novel holster invention.
Figure 2:
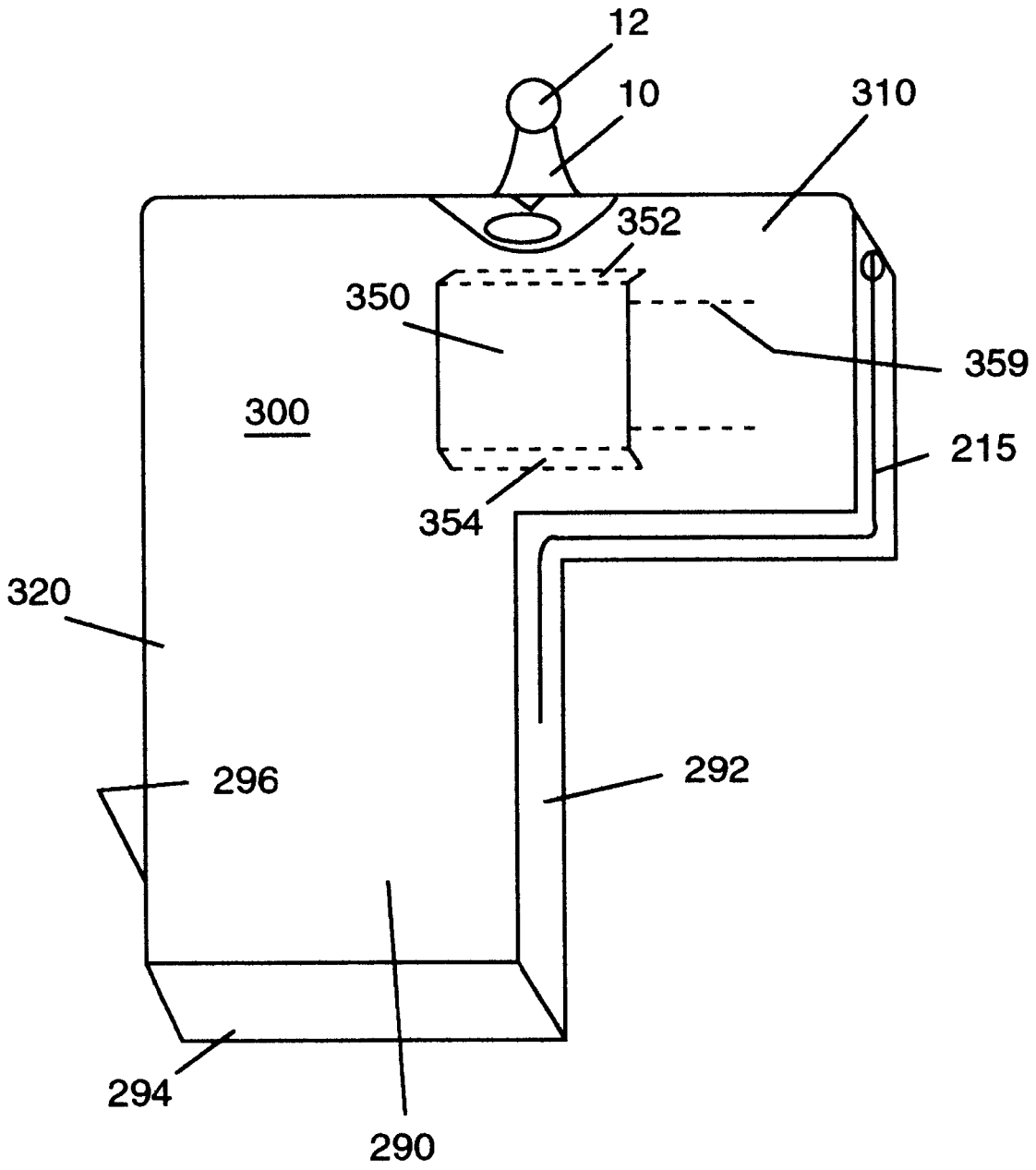
FIG. 2 is a rear view of the holster of FIG. 1.
Figure 3:
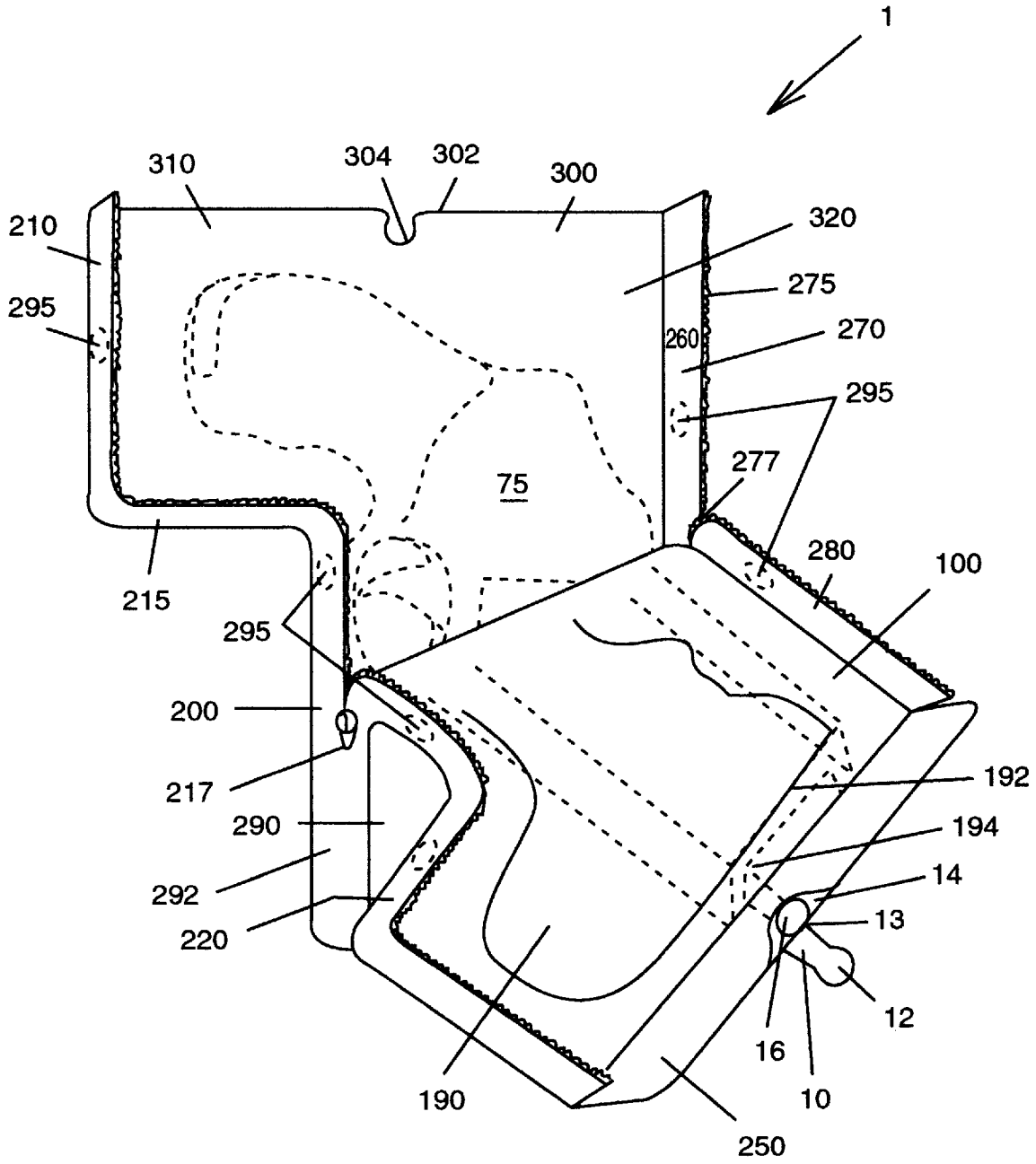
FIG. 3 is a view of the holster of FIG. 1 in an open position.
Figure 4:
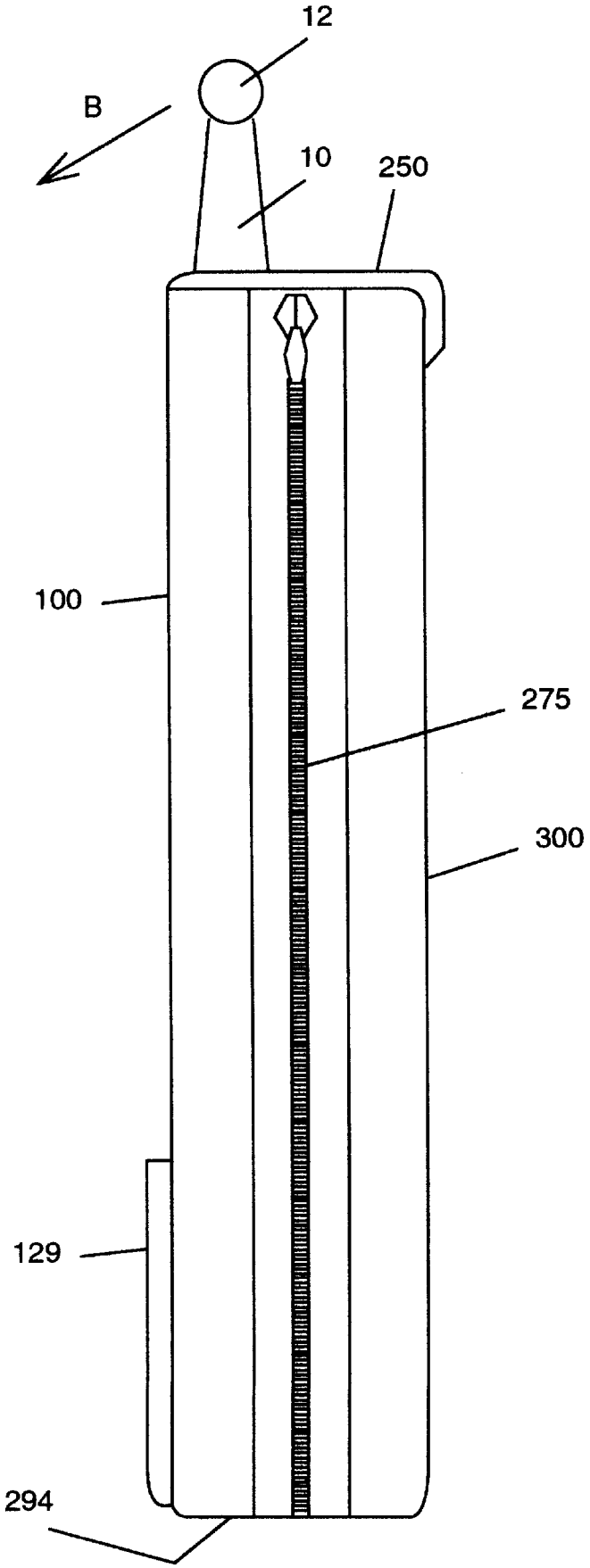
FIG. 4 is a side view of the holster of FIG. 1 along arrow A.

FIG. 1 is a perspective view 1 of a preferred embodiment of the novel holster invention. FIG. 2 is a rear view of the holster 1 of FIG. 1. FIG. 3 is a view of the holster 1 of FIG. 1 in an open position. FIG. 4 is a side view of the holster of FIG. 1 along arrow A. Referring to FIGS. 1–4, holster 1 includes opposing upside down L-shaped walls 100 and 300. Front wall 100 include an upper left rectangular section 110 with the exterior appearance to resemble and electronic beeper/pager with reflective windows 112 such as colored plastic and the like. Front wall 100 also includes a vertical rectangle portion 120 having a small grouping of holes 122 which would represent speaker holes for a portable phone/cellular phone and the like. Optionally, section 110 can be labelled a battery pack for use with phone section 120. A sewn up flap 129 can also be used to add to the realistic effect of the holster 1. Groove lines 105 on the surface of front wall 100 can add to the visual effect thereof. On the interior surface of front wall 100 can be a foam type insert 190 which would allow a tighter fit of the weapon 75 within the holster 1. Foam insert 190 can be attached to the interior of front wall 100 of holster 1 by various fasteners such as but not limited to hook and loop(Velcro®), sewn, and the like. When inserting the firearm 75, the foam compresses and wedges between holster 1 and weapon 75 securing the latter in place. Optionally, the interior of the front wall 100 can include a sewn on pocket 192 that can house a real portable phone/radio-transmitter-receiver 194, where the real antenna can be used as 10, 12. Rear L-shaped wall 300 can include similar upper left rectangular section 310 and vertical rectangular section 320. Left side 200 of holster 1 has flap portions 210 and 220 fastened together by a zipper 215 with tab 217. Similarly right side 260 of holster 1 has flap portions 270 and 280 fastened together by a zipper 275 with tab 277. On the exterior of rear L-shaped wall 300 is a sewn on clip 350 having its edges 352, 354 sewn to wall surface 300, so that a belt 359 of a user can be inserted therein. A permanent bottom pocket 290 having sides 292, 296 and bottom 294 formed about a lower portion of vertical rectangular portions 120 and 320 allows for supporting the muzzle of a firearm 75 inside holster 1. The holster can be formed from various materials such as but not limited to vinyl, nylon, leather, plastic, burlap, combinations, thereof, and the like.

Referring to FIGS. 1–4, a rigid plastic antenna 10 and can have a ball-shaped top 12 with a bottom end 13 sewn, screwed or glued onto top flap 250 of front wall 100. On top flap 250 is a downwardly bent flap edge 14 having a button 16 thereon, the latter of which inserts and connects into a curved notch opening 304 in the top edge 302 of rear wall 300. Optionally, a fastener such as Velcro® can be used. In operation the user can with one motion push the antenna 10, 12 forward in the direction of arrow B(See FIG. 4) causing the button 16 to pop out from notch 304 and further cause side zippers 215 and 275 to open, exposing firearm 75 for removal.

Figure 5:
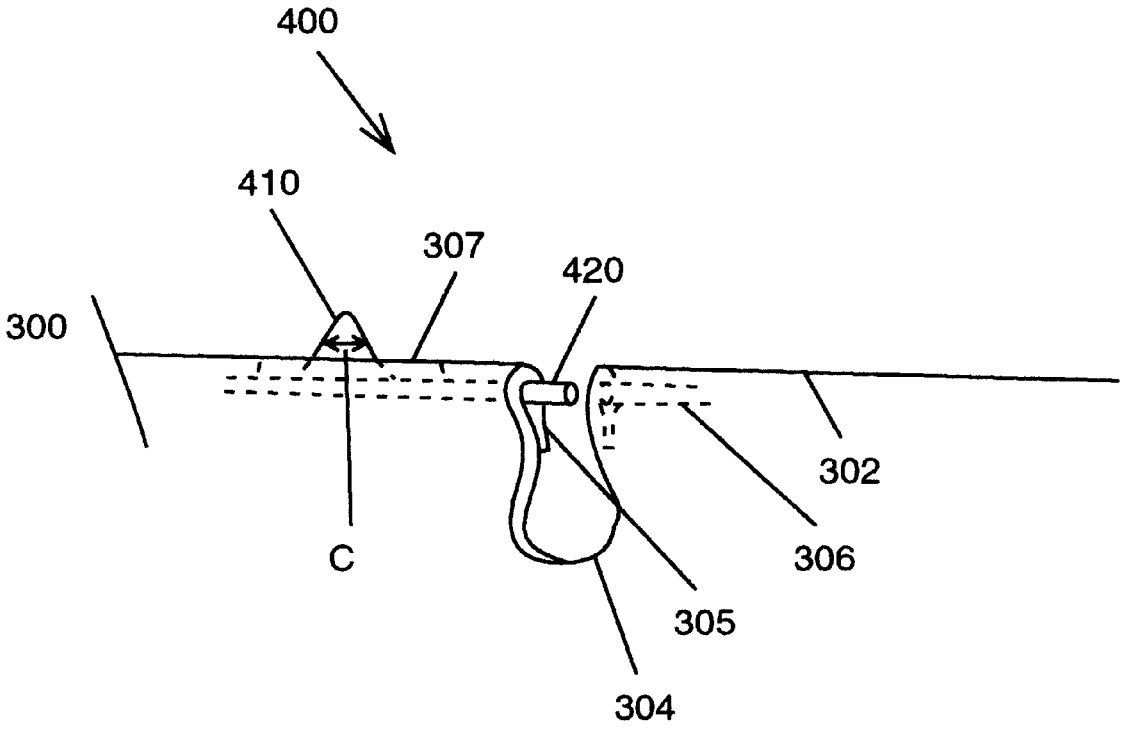
FIG. 5 is an enlarged view of a safety-switch notch locking pin that can be used with the holster of FIGS. 1–4.

FIG. 5 is an enlarged view 400 of an optional safety-switch notch locking pin 420 that can be used with the holster 1 of FIGS. 1–4. Referring to FIGS. 1–5, material 305 of rear wall 300 can wrap over top edge 302 forming a longitudinal through-hole 306. A longitudinal pin/bolt 420 having a raised handle 410, the latter of which can move in the directions of arrow C inside a slit 307 allows the bolt/pin 420 to open and close notch 304. In the closed position, bolt/pin 420 holds button 16 together with flap edge 14 and top flap 250 of holster 1. The bolt/pin 410, 420 can be used as a type of safety switch, wherein the notch 304 being in an open position allows antenna 10, 12 to be moved in the direction of arrow B(FIG. 4) allowing the firearm/weapon 75 to be removed. Safety-switch 400 helps prevent any unwanted access to firearm/weapon 75.

FIG. 6 is an enlarged view 500 of an optional blinking light 562 and beep/ring emitting speaker 564 that can be used with the antenna 10, 12 of FIGS. 1–3. FIG. 7 is a schematic circuit 550 that can be used with the light 562 and speaker 564 of FIG. 6. Referring to FIGS. 6–7, a battery power source 552 of approximately 5 volts, such as those used in watches, and the like, connects to a switch 554 (which will be later explained in detail) to an integrated circuit(I.C.) clock chip with timer 556 such as a triple five(5) chip. From chip 556, the current from battery 552 is directed to a speaker 564 and light source 562, such as a light emitting diode 562. Switch 554 can be the antenna 510 rotated about a ¼ of a turn in the direction of arrow E, wherein the expanding base 512 of the antenna can be held in place in the space formed between layers 252 and 254 of top flap 250. Alternatively, switch 554 can be a press-button switch beneath top layer 252.

While the preferred embodiment is shown using zippers (215, 275 of FIG. 3) down the sides of the holster, other fasteners can be used such as but not limited to snaps(see 295 FIG. 3), hook and loop fasteners(Velcro®)(see 215, 275 of FIG. 3), and the like.

Although the preferred embodiment has been described for use with firearms/weapons such as handguns, the invention can be applicable to holstering other weapons such as but not limited to electric shock prong devices such as Zappers®, knife, aerosol dispensers for teargas and mace, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A concealed holster for a weapon to be worn on an exterior portion of a user, comprising:

an upside down L-shaped holster having a horizontal housing portion, a vertical housing portion, a front face having a flap cover, and a rear face, the front face connected to the rear face on each side by longitudinal side fasteners, the front face disguising the holster to be housing electronic equipment other than a weapon;

a clip attached to a rear surface of the holster for allowing a belt worn by a user to support the holster, wherein the holster supports and substantially conceals a weapon inside; and a rigid antenna connected to and upwardly extending from a mid-portion of the flap cover of the holster, wherein a hand of the user quickly pushing down solely on the antenna connected to the flap cover causes the front face to separate along each of the longitudinal side fasteners from the rear face of the holster to allow the weapon to be easily and quickly retrieved.

2. The concealed holster of claim 1, wherein the horizontal housing portion includes:

an exterior face having a facade of at least one of: a pager, a beeper and a battery pack.

3. The concealed holster of claim 2, wherein the vertical housing portion includes:

an exterior face having a facade for housing at least one of: a portable phone and a radio transmitter-receiver.

4. The concealed holster of claim 3, wherein the facade housing further includes:

means for producing at least one of: sounds and lights.

5. The concealed holster of claim 1, wherein the front face and the rear face of a lower section of the vertical housing portion are fixed to one another and do not detach from one another.

6. The concealed holster of claim 1 wherein the antenna is fixably connected to the holster.

7. The concealed holster of claim 6, further including:

a fastening means for securing the flap cover of the front face and the rear face together.

8. The concealed holster of claim 1, wherein the longitudinal side fasteners include:

hook and loop fasteners.

9. The concealed holster of claim 1, wherein the longitudinal side fasteners include:

snaps.

10. The concealed holster of claim 1, wherein the longitudinal side fasteners include:

a zipper.

11. The concealed holster of claim 1, wherein the clip further includes:

a fixed through-hole for allowing the belt to be passed therethrough.

12. The concealed holster of claim 1, wherein the weapon includes:

a firearm.

13. The concealed holster of claim 1, wherein the weapon includes at least one of:

a spray dispenser weapon and a knife.

14. The concealed holster of claim 1, wherein the weapon includes:

an electrical discharge weapon.

15. The concealed holster of claim 1, further comprising:

a foam insert attached to an interior portion of the front face, for pressing against the weapon.

16. The concealed holster of claim 1, further comprising:

a safety means attached to the holster for preventing accidental release of the weapon.

17. A concealed weapon holster to be worn by a user, comprising:

a first housing portion having an exterior facade for representing contents within the first housing portion to be at least one of: a pager, a beeper and a battery pack;

a second housing portion attached to and being larger than the first housing portion, the second housing portion having an exterior facade for representing contents within the second housing portion to be at least one of: a portable phone and a radio transmitter-receiver, wherein the holster is used to support a weapon inside, the first and the second housing portion having a front face and a rear face, the front face connected to the rear face on each side with longitudinal side fasteners; and a rigid antenna connected to and upwardly extending from a mid-portion of a flap cover of the holster, wherein a hand of the user quickly pushing down solely on the antenna connected to the front cover causes a portion of the front face of the holster to separate along each of the longitudinal side fasteners from the rear face of the holster to allow the weapon to be easily and quickly retrieved.

* * * * *